United States Patent [19]

Haeussler

[11] 3,996,713

[45] Dec. 14, 1976

[54] PREFABRICATED MULTI-LAYER STEEL-REINFORCED CONCRETE PANELS

[76] Inventor: Ernst Haeussler, Grashofstrasse 47, 4300 Essen-Bredeney, Germany

[22] Filed: Mar. 31, 1976

[21] Appl. No.: 672,338

[30] Foreign Application Priority Data

Apr. 2, 1975 Germany ..... 2514300

[52] U.S. Cl. ..... 52/309; 52/378; 52/405; 52/410; 52/650; 52/686

[51] Int. Cl.[2] ..... E04B 2/28

[58] Field of Search ..... 52/405, 383, 600, 410, 52/426, 677, 687, 686, 650, 378

[56] References Cited

UNITED STATES PATENTS

| | | | |
|---|---|---|---|
| 2,794,336 | 6/1957 | Ballou | 52/687 |
| 3,138,899 | 6/1964 | Hadley | 52/410 |
| 3,237,357 | 3/1966 | Hutchings | 52/410 |
| 3,476,912 | 11/1969 | Garrison | 52/410 |
| 3,757,482 | 9/1973 | Haeussler | 52/405 |

*Primary Examiner*—John E. Murtagh
*Attorney, Agent, or Firm*—Karl F. Ross; Herbert Dubno

[57] ABSTRACT

A sandwich panel assembly or slab structure has a pair of steel-reinforced concrete plates generally coextensive with one another and a cushion of insulating foamed synthetic resin therebetween. A tubular anchor is located at the center (centroid) of at least a portion of the panel and is embedded in the concrete plates. At least one slightly flexible elongated auxiliary anchor plate or membrane sheet provides additional fixation of the assembly. This membrane is spaced from the tubular anchor and traverses the resin cushion and is embedded in each of the concrete plates. Metal bars extend through and from the membrane and are embedded in the concrete plates.

15 Claims, 6 Drawing Figures

PREFABRICATED MULTI-LAYER STEEL-REINFORCED CONCRETE PANELS

FIELD OF THE INVENTION

My present invention relates to a panel or slab construction assembled from a pair of outer steel-reinforced concrete plates and an inner insulating cushion made of a resinous foamed material sandwiched between these plates.

BACKGROUND OF THE INVENTION

The requirements of rapid construction and the high labor cost of on-site construction have led to increasing use of prefabricated panels or slabs.

Concrete sandwich panels have proved successful for such purposes. The panel can include a pair of concrete plates sandwiching therebetween a foamed insulating layer made of a resinous material and held together by anchors embedded in the plates and traversing the intermediate layer.

I have described in my German Printed Application (Offenlegungsschrift) DT-OS 2,008,402 and in U.S. Pat. No. 3,757,482 the use of a tubular anchor.

This anchor is in the form of a cylinder or a sleeve embedded in both of the concrete plates and passing through the foamed resin cushion. At either end of this tubular anchor, at least now row of openings is provided and opposite pairs of these openings are traversed by a reinforcing or anchoring metal (steel) bar which is embedded in the concrete mass.

These tubular anchors have the rigidity characteristic of tubular formations in general. Since such anchors are relatively stiff, to accommodate limited relative mobility of the plates, only a small number of such anchors (usually only one) could be used for each panel or slab construction.

To accommodate thermal dimensional changes and like movements, while maintaining a secure interconnection of the plates, in addition to the tubular anchor, the plates are connected by auxiliary anchors.

The latter have generally been curved hairpin-like fasteners having a U-bent elbow and two tines. The bent elbow of these pins is embedded in one of the concrete plates and the tines of the pins are undulated at their ends and are embedded in the other of the concrete plates. A large number of such pins are required and the specific stress to which they are subjected is considerable, so that they tend to break.

OBJECTS OF THE INVENTION

It is therefore an object of my present invention to provide an improved multilayer assembly of a pair of steel-reinforced concrete plates and of a resinous foamed cushion between these plates wherein a small number of auxiliary anchors provides a satisfactory and slightly flexible bond between the concrete plates and the foamed resinous cushion.

Another object of the invention is to provide a sandwich slab or panel structure obviating the aforementioned disadvantages while retaining the advantages of the aforedescribed anchor.

SUMMARY OF THE INVENTION

These objects are attained according to the invention in a panel wherein the pair of outer steel-reinforced concrete plates sandwiching therebetween a resinous foamed insulating cushion layer are firmly connected by a single tubular anchor (main anchor) located in the centroid of the panel. This centroid may be the center of the composite panel, or an intersection of symmetry axes or even the center of a statically self-dependent area of the panel. Most commonly it is the intersection of a pair of diagonals of a rectangular panel or a rectangular section of a panel.

The additional binding between the concrete panels and the resinous cushion is provided by at least one planar metallic (steel) auxiliary anchor plate or sheet functioning as a kind of flexible membrane. This plate passes through the resinous cushion and reaches into both the outer concrete plates by its edge area.

This anchor plate is spaced from the main tubular anchor and is orthogonal to a radius of the main anchor extending to this plate. It is particularly advantageous to position this anchor plate parallel to the axis of the main tubular anchor.

A plurality of elongated reinforcing elements, such as steel bars, extend through this plate and outwardly therefrom and are embedded in each of the concrete plates. These reinforcing elements may be part of or separate from the reinforcing rods of the respective plate.

When the panel has a quadrangular shape and the main tublar anchor is located at the cross-point or intersection of the diagonals, it should also have one such auxiliary anchor plate or membrane on each diagonal in each corner of the panel. Where the panel has an irregular shape, the main tubular anchor will be located in the centroid of a portion thereof and the auxiliary anchor plate will be inside another portion of the panel. Thus with a panel having a U-plan configuration, the main tubular anchor will pass through one leg of the U and the auxiliary anchor plate will be located in the other leg of the U.

Particularly suitable is an auxiliary anchor plate having a length equal to the developed length or circumference of the main tubular anchor.

For the purpose of use of steel bars of various diameters, for locating these bars at different levels and/or allowing these bars free play within the holes of the anchol plate, the holes in this plate may be arranged in several parallel rows. The reinforcing steel bars are not firmly fixed in the auxiliary anchor plate but are relatively freely passed through a plurality of holes provided adjacent the longitudinal edges of the anchor plate. This type of structure is very advantageous because these reinforcing bars, which are firmly embedded in the concrete mass, have some play in the holes and thus attain flexibility enhancing their capacity for yielding to the motions of the concrete plates.

The tubular anchor itself has a diameter which substantially corresponds to the thickness of the respective concrete plates. It is also possible to insert into the tubular anchor a stopper made of an insulating material.

As already mentioned, the membrane-like flexible auxiliary anchor plate has near each edge thereof a plurality of rows of holes into which the reinforcing bars may be inserted. Thereby, the holes remaining free also contribute to the anchoring of concrete therein.

According to my present invention there may also be soldered on or welded to the anchor plate near each edge thereof at least one additional anchoring member.

This arrangement of interconnections between the pair of outer concrete plates and the foamed resinous cushion is very effective and cable of reliably keeping together all parts of this assembly, so that the panel copes with all static requirements.

This arrangement also provides a rigid interconnection by means of the tubular anchor which is positioned in the appropriate centroid of the mass of the panel, i.e. where no relative movements of the concrete plates take place with regard to each other.

In this arrangement, the membrane-like anchor plates elastically participate in the relative motions between the outer concrete plates whenever such motions occur during utilization of the panel. The membrane-like anchor plates take up all relative motions between the concrete plates caused, for instance, by thermal expansion and the like. The centroid and/or centroids wherein the main tubular anchor is located is the center of such motions and/or deformations which occur after the composite panel has been installed.

The number of the auxiliary anchor plates may, in accordance with my invention, extremely low annd their loading will be relatively slight. These auxiliary anchor plates eliminate the need for needle and/or hairpin-like connecting elements and the pressure on the surface of these auxiliary anchor plates will be relatively low. Consequently, these anchor plates undergo a very limited inflection and do not disrupt the concrete in which they are embedded.

The pair of concrete plates of the panel is linked together by the auxiliary anchor plate penetrating thereinto by and along its edges. The strength of this connection is enhanced by the concrete mass which enters the holes parallel with these edges. The use of elongated members passed through these holes and embedded in both of the concrete plates further strengthens the connection.

BRIEF DESCRIPTION OF THE DRAWING

The above and other features of my invention will now be described in detail with reference to the accompanying drawing in which.

SPECIFIC DESCRIPTION

Figure 1:
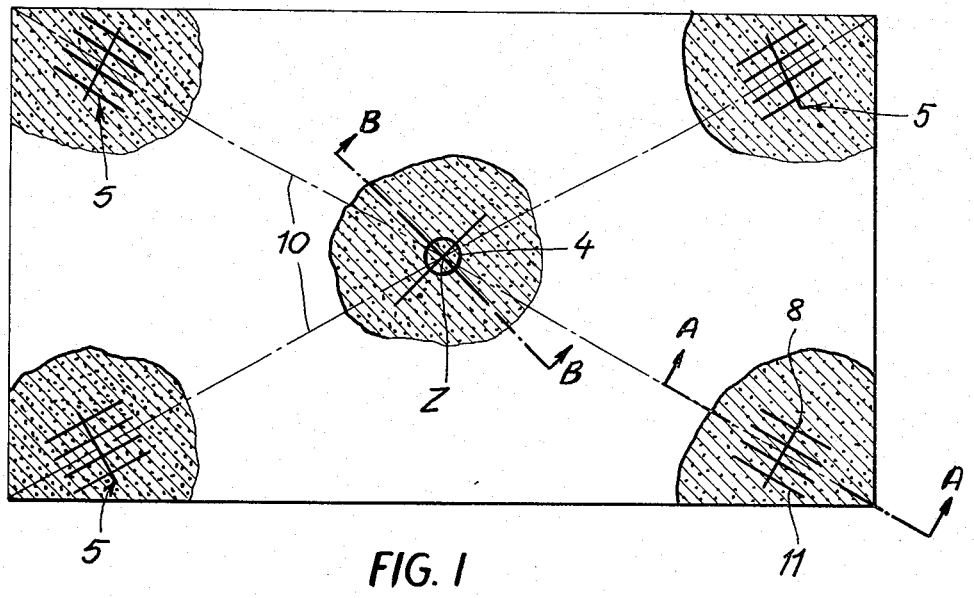
FIG. 1 is a plan view of an embodiment of a composite steel-reinforced concrete panel according to my present invention, partly broken away.

In the drawing, in all the Figures, the assembly of the panel is illustrated, and is to be understood, as comprising a steel-reinforced upper concrete plate 1, a steel-reinforced lower concrete plate 2 and an intermediate insulating layer 3 made of a resinous foamed material (e.g. a polyurethane — see U.S. Pat. No. 3,751,482). The upper concrete plate 1 and the lower concrete plate 2 are coextensive and are interconnected by a single tubular anchor 4 and by means of several auxiliary anchors 5 spaced from the tubular anchor 4 and providing a static linkage.

Figure 2:
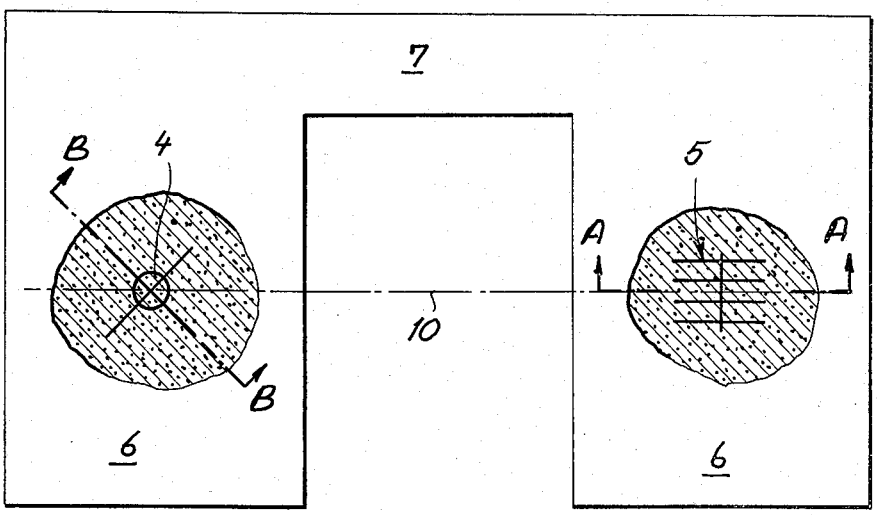
FIG. 2 is a plan view of an embodiment of my invention having a shape different from the panel of FIG. 1.

FIGS. 1 and 2 show that, according to the present invention, each panel has a single tubular anchor 4. This single tubular anchor 4 is located at the centroid Z either of the entire panel combined from the concrete plates 1 and 2 and the cushion 3 or in the centroid of one of its areas. Thus, the centroid is to be understood to lie, for instance, at the intersection of axes of symmetry of the panel, or located in the symmetry center of substantially statically self-contained areas of the panel.

FIG. 1 illustrates a panel according to my invention having rectangular configuration. FIG. 2 shows a panel of my invention having a U-shaped configuration, whose two wide legs are interconnected by a lateral bridge section 7.

In all the embodiments, the auxiliary anchor 5 functions as a membrane. This auxiliary anchor 5 includes a planar metallic plate 8 having holes 9 in the area adjacent its two longitudinal edges. At each of the areas containing the holes 9, the metallic plate 8 is embedded, on the one and the other side thereof, in the upper and lower concrete plates 1 and 2.

The holes 9 may be arranged in one row or in several parallel rows and may have different forms and dimensions. The membrane-like metallic plate 8 of the auxiliary anchor 5 is positioned orthogonally in regard to a connecting line 10 passing through the centers of the auxiliary anchor 5 and of the tubular anchor 4. This is clearly shown in FIGS. 1 and 2. Generally, this metallic plate 8 has in the illustrated embodiments a length approximately corresponding to the circumference of the tubular anchor 4. The tubular anchor 4 has a diameter corresponding at least to be thickness of one of the concrete plates.

Figure 3:
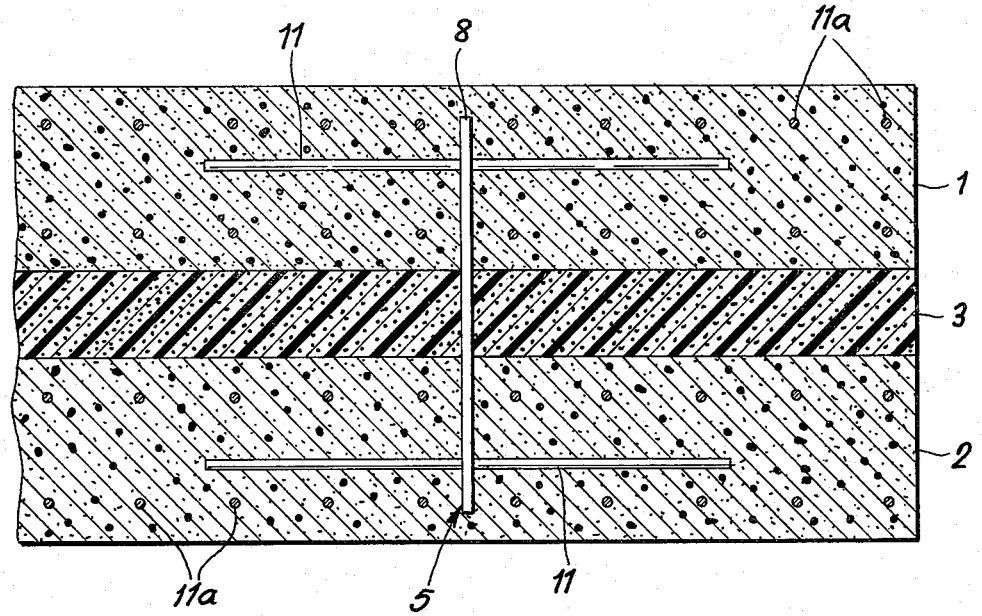
FIG. 3 is a cross-section taken along the line A —A of FIG. 1 or FIG. 2, on an enlarged scale.
Figure 4:
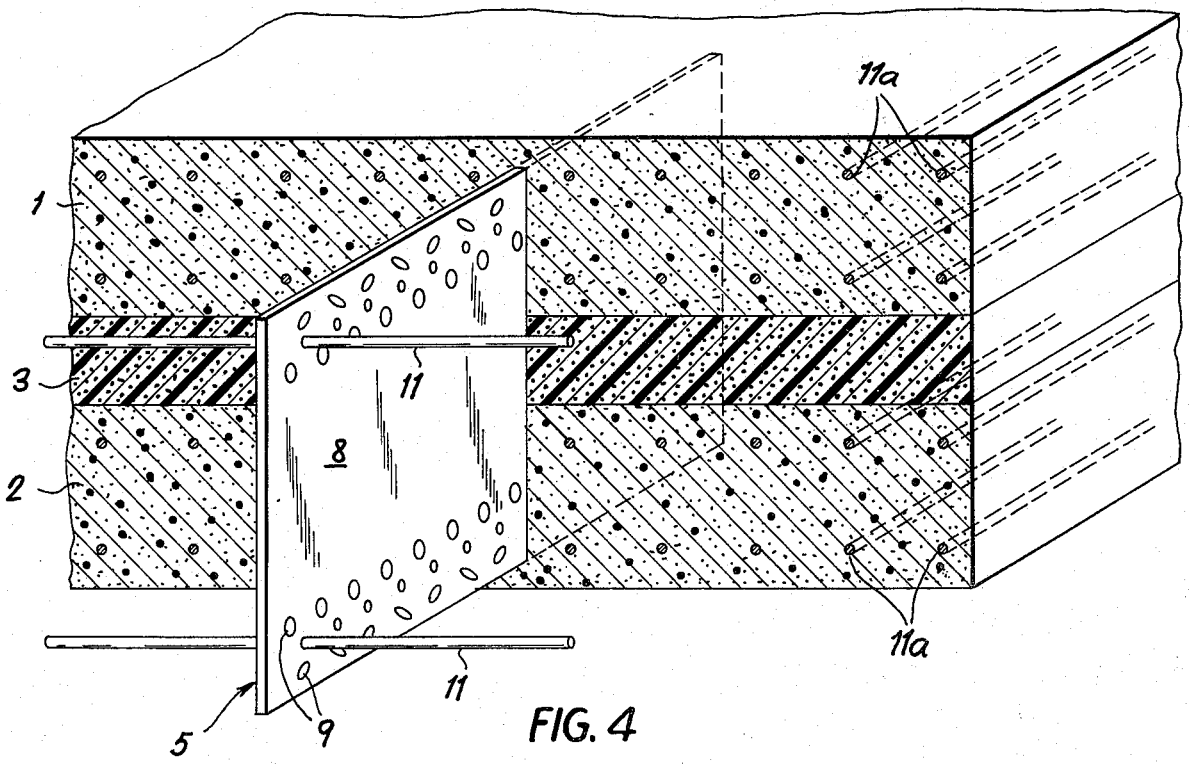
FIG. 4 is a perspective detail view of the panel shown in FIG, 3, partly broken away.
Figure 5:
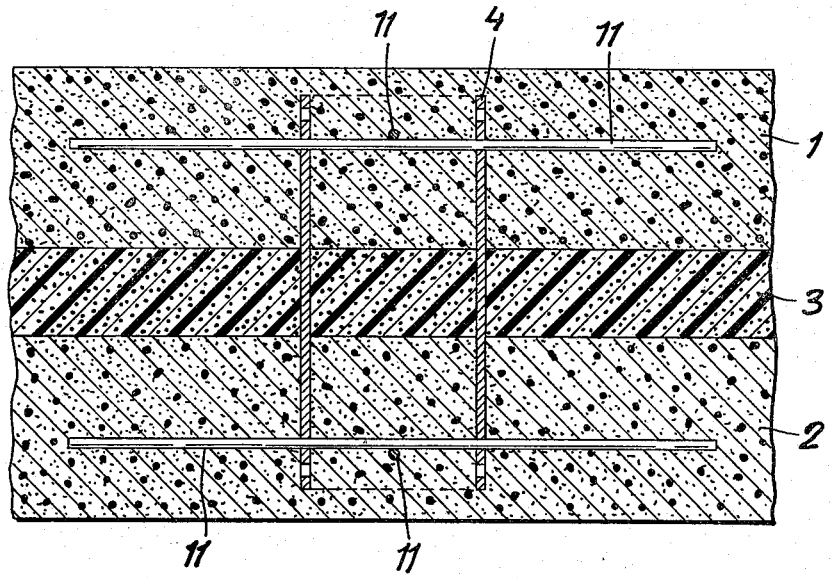
FIG. 5 is a cross-section along the line B — B of the panel of FIG. 1 or FIG. 2.
Figure 6:
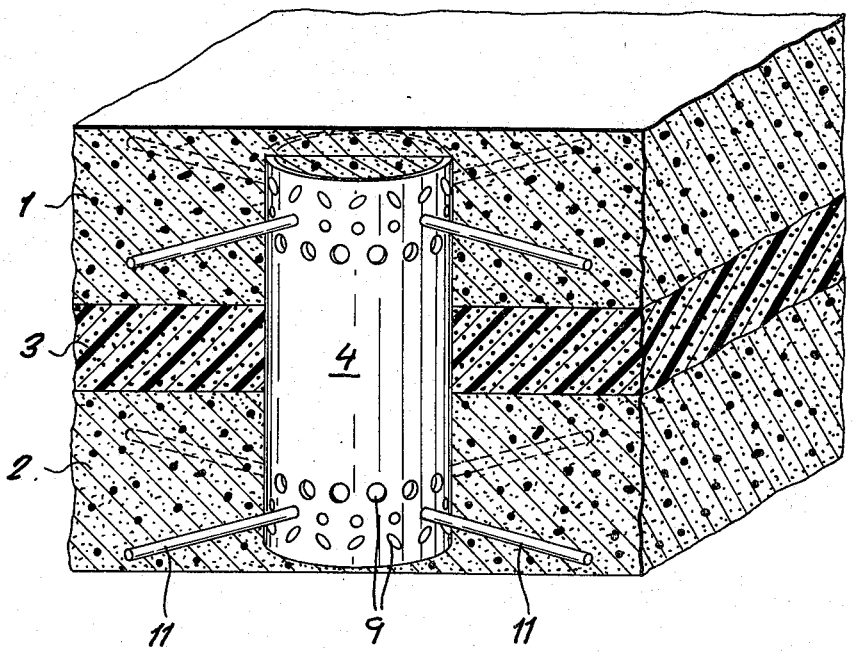
FIG. 6 is a view similar to FIG. 3 of the tubular anchor.

As is apparent in particular from FIG. 4, the membrake-like metallic plate 8 of the auxiliary anchor 5 has several rows of holes 9 in two opposite areas reaching into the one and the other concrete plate 1 and 2. At least some of these circular and/or oval holes 9 are used for insertion of anchoring steel bars 11 as is visible especially from FIGS. 3 and 4. The anchoring bars 11 are illustrated as passing through the circular holes 9; however, they may also be selectively positioned through the other holes. The oval larger holes receive concrete. The anchoring bars 11 may be soldered to or welded onto thhe metallic plate 8. However, they may simply pass through the holes 9 for limited freedom of movement in regard to the metallic plate 8.

FIGS. 3 and 4 provide a more distinctive illustration of the composition of the panel according to my invention. The upper and lower concrete plates 1 and 2 are shown as reinforced by steel or iron bars 11*a*. Such bars, as is known in the art, may be either parallel as shown or arranged in a network or the like.

Returning now to FIG. 1, in the embodiment there shown, the assembly combined from the upper and lower concrete plates 1 and 2 with resinous foamed cushion 3 sandwiched therebetween has a rectangular configuration. Here, the tubular anchor 4 is shown as located at the intersection of the diagonals and one auxiliary anchor 5 is shown on each diagonal at respective corners of the panel.

In FIG. 2 where, as has been mentioned above, the panel is of U shape, the tubular anchor 4 is located in the center or centroid of one of the legs 6 of the U, while the auxiliary anchor is located in the other leg 6 of the U.

I claim:

1. A prefabricated multi-layer panel comprising:

a pair of spaced-apart and coextensive steel-reinforced concrete plates;

an insulating layer sandwiched between said plates;

a tubular main anchor extending between said plates and reaching into each of them, said main anchor being positioned at the centroid of at least one portion of said panel;

elongated reinforcing members laterally projecting from said main anchor and embedded in the concrete plates;

at least one planar auxiliary anchor spaced from said main anchor, reaching into both said concrete plates and having a membrane sheet orthogonal to a radius of said main anchor; and a plurality of elongated reinforcing elements traversing said membrane sheet and embedded in said concrete plates.

2. A panel as set forth in claim 1 wherein said insulating layer is a cushion of a foamed resinous material.

3. A panel as set forth in claim 1 wherein said centroid lies at the intersection of two symmetry axes of said plates.

4. A panel as set forth in claim 1 wherein said concrete plates are rectangular and said centroid lies at the intersection of their diagonals.

5. A panel as set forth in claim 1 wherein said membrane sheet has a length approximately equal to the circumference of said tubular main anchor.

6. A panel as set forth in claim 1 wherein said membrane sheet lies in a plane parallel to the axis of said main anchor.

7. A panel as set forth in claim 1 wherein said main anchor has in the area adjacent its upper and lower edge peripherally distributed holes and each of said reinforcing members is passed through two opposite ones of these holes.

8. A panel as set forth in claim 7 wherein said holes are arranged in at least one peripherally extending row adjacent each edge of said main anchor.

9. A panel as set forth in claim 1 wherein said membrane has in the areas adjacent its longitudinal edges embedded in said plates a multiplicity of spaced-apart holes and said reinforcing elements pass through at least some of said holes.

10. A panel as set forth in claim 9 wherein said holes are arranged in at least one row adjacent each longitudinal edge of said membrane sheets.

11. A panel as set forth in claim 1 wherein said elongated reinforcing members and elements are steel bars.

12. A panel as set forth in claim 1 wherein said panel is rectangular, said main anchor is located at the center of the panel and a respective one of said auxiliary anchors is located on each panel diagonal in the area of each panel corner.

13. A panel as set forth in claim 1 wherein said panel has a U-plan configuration, said main anchor is located at the centroid of one leg of the u while said auxiliary anchor lies at the centroid of the other leg of said U-plan configuration.

14. A panel as set forth in claim 1 wherein said anchors are composed of steel.

15. A panel as defined in claim 8 wherein several parallel rows of holes are provided along the longitudinal edges of said membrane sheet, said holes in different rows having different diameters for receiving steel bars of different diamters constituting said elements.

* * * * *